US006241313B1

(12) United States Patent
Lenz et al.

(10) Patent No.: US 6,241,313 B1
(45) Date of Patent: Jun. 5, 2001

(54) CHILD SEAT ATTACHABLE TO A SUITCASE

(76) Inventors: Randall G. Lenz; Darryl H. Lenz, both of 741 NW. 42nd Way, Deerfield Beach, FL (US) 33442-9221

( * ) Notice: Subject to any disclaimer, the term of this patent is extended or adjusted under 35 U.S.C. 154(b) by 0 days.

(21) Appl. No.: 09/573,713

(22) Filed: May 18, 2000

(51) Int. Cl.[7] ..... A47C 31/00

(52) U.S. Cl. ..... 297/217.1; 297/188.2; 297/188.06

(58) Field of Search ..... 297/254, 250.1, 297/188.04, 188.06, 188.07, 217.1, 256.16, 463.2, 255, 256, 39; 280/47.17, 47.25, 47.4, 47.39; 190/8

(56) References Cited

U.S. PATENT DOCUMENTS 290,344 * 12/1883 Morris .
820,125 * 5/1906 Pennington .
2,724,429 * 11/1955 Warner .
2,875,816 * 3/1959 Langefeld .
3,506,280 * 4/1970 Coupe .
5,374,073 * 12/1994 Hung-Hsin .
5,507,508 * 4/1996 Liang .
5,642,917 * 7/1997 Geiger .
5,695,246 * 12/1997 Tsai .
5,868,463 * 2/1999 MacKenzie et al. .
5,988,657 * 11/1999 Henkel .

FOREIGN PATENT DOCUMENTS

1073861 * 9/1954 (FR) .
100110 * 6/1962 (NO) .

* cited by examiner

*Primary Examiner*—Milton Nelson, Jr.
(74) *Attorney, Agent, or Firm*—Robert M. Downey, P.A.

(57) ABSTRACT

A child seat for removable attachment to a suitcase includes a collapsible frame structure formed and configured to support a seat base, a back rest, opposite arm rests, and a front leg support extending downwardly from the seat base. A size adjustable harness for securing a child in the seat is fitted to the frame structure on the seat base. Elongate strap members extend from the frame structure and include an upper pair of strap members and a lower pair of strap members, wherein strap segments of each pair of strap members are attachable by clips to form a closed loop about the suitcase. An adjustment fitting enables the strap members to be tightened in order to secure the child seat to the suitcase, thereby permitting the user to conveniently transport the suitcase and seated child, as a unit, through an airport, hotel, along a sidewalk or the like.

19 Claims, 3 Drawing Sheets

CHILD SEAT ATTACHABLE TO A SUITCASE

BACKGROUND OF THE INVENTION

1. Field of the Invention

The present invention is related to a portable child seat and, more specifically, to a child seat which is removably attachable to the side of a suitcase or other luggage piece, wherein the suitcase can be transported across a floor surface, with the seat attached, while a child is secured in the seat.

2. Description of the Related Art

Every parent has experienced the frustrations of traveling with small children, particularly, when carrying several pieces of luggage. As small children are unable to walk longer distances, at a relatively fast pace, many times parents find themselves having to carry their children along with their belongings. Moreover, it is highly advisable for parents to hold onto their children when traveling through congested areas, such as airports. Thus, it is not surprising that strollers have become a popular travel accessory. In fact, many airlines permit passengers to wheel their children all the way to the gate, in spite of the fact that the stroller is too large to be carried on the plane. Typically, airline personnel will take baby strollers from passengers, just prior to boarding the plane, and stow the strollers in the aircraft's cargo compartment. When the plane arrives at its destination, the strollers are carried up the stairs of the jet way and returned to passengers as they deboard the plane. Often, this results in some delay and passenger congestion at the exit of the plane as parents wait for their strollers. It can therefore be appreciated that, notwithstanding their general usefulness, baby strollers can present a significant inconvenience, especially when traveling by airline.

In the past, others have proposed specifically designed suitcases in an effort to overcome the problems encountered when traveling with small children. In particular, the U.S. patent to Henkel, No. 5,988,657, discloses a multi-purpose suitcase having a base compartment and a movable upper compartment. The suitcase is adapted to be quickly reconfigured to form a seat on which a child can be seated. A harness secures a child in the seat. The U.S. patent to Alper, et al., No. 5,407,039, discloses a wheeled luggage case which is specifically structured to allow a child seat to be fastened to the case. These and other proposed solutions involve use of a specifically designed suitcase, thus requiring the user to purchase a new article of luggage. For obvious reasons, these specifically designed suitcases are not practical for the average traveler. In particular, a specifically designed luggage piece of this nature can be considerably expensive. Moreover, many travelers already have a set of matching luggage and it is not desirable to purchase a separate suitcase which does not match the previously purchased luggage set. Additionally, the proposed suitcases, with means for seating a child thereon, are for the most part bulky and aesthetically unappealing.

In view of the foregoing difficulties associated with traveling with small children, there still exists a need for a convenient and effective means of carrying one's children and luggage without having to transport a large, cumbersome baby stroller. Furthermore, there is a need for an inexpensive, lightweight child seat which is adapted for universal attachment to existing articles of luggage, thereby enabling a parent to quickly and conveniently adapt their existing luggage to accommodate a securely seated child thereon.

SUMMARY OF THE INVENTION

The present invention is directed to a child seat for removable attachment to a suitcase, so that the suitcase and a child within the seat can be rolled along a floor surface as an integral unit. The child seat comprises a collapsible frame structure which is formed and configured to provide a seat base frame, a back rest frame, opposite arm rest frames, and a front leg support extending downwardly from the seat base frame. Fabric panels may be fitted to the seat base frame and the back rest frame to provide a seat base and a back rest, respectively. Arm rests may be fitted to the arm rest frame portions for providing a comfortable resting surface for the child's arms.

Harness means are provided for securing the child in the seat. The child seat further includes means for removably securing the child seat to a suitcase including strap members which secure about the suitcase.

When not in use, the child seat folds to a collapsed position, much like a conventional beach chair, thereby assuming a low profile configuration, lying flat against the front panel of the suitcase. In use, the seat base, arm rests, and front leg support swing outwardly away from the suitcase, assuming an operative position so that a child can be seated therein.

The present invention is particularly adapted for use with a suitcase of the type including wheels on a bottom end and an extendable tote handle on the top end. With the back rest of the child seat placed against the front panel of the suitcase, an upper pair of straps extend over the top end of the suitcase and about the tote handle. A lower pair of straps extend about the body of the suitcase, at an approximate mid zone thereof. Size adjustment fittings on the straps permit tightening of the straps about the tote handle and suitcase body to tightly secure the child seat to the suitcase. A wrist strap may further be provided for securing the tote handle to the wrist of the person carrying the suitcase for preventing accidental dropping of the suitcase, thereby avoiding injury to a child carried in the child's seat.

OBJECTS AND ADVANTAGES OF THE PRESENT INVENTION

With the foregoing in mind, it is a primary object of the present invention to provide a convenient, lightweight and collapsible child seat which enables a parent to effectively carry their child and luggage without the use of a cumbersome baby stroller.

It is a further object of the present invention to provide a lightweight, collapsible child seat which is removably attachable to a suitcase of the type having wheels and a tote handle, and wherein the child seat is collapsible against the front panel of the suitcase to assume a low profile, stowed position.

It is still a further object of the present invention to provide a lightweight, collapsible child seat which is removably attachable to a conventional luggage piece, of the type including wheels and an extendable tote handle, and wherein the child seat is easily removable and attachable to the luggage piece.

It is still a further object of the present invention to provide a lightweight, collapsible child seat which is specifically adapted for removable attachment to a luggage piece, wherein the luggage piece includes wheels and a tote handle and is of a size which can be carried on a commercial airliner so that the child seat and luggage piece can be stowed, as an integral unit in an overhead compartment of the airliner.

These and other objects and advantages of the present invention will be more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
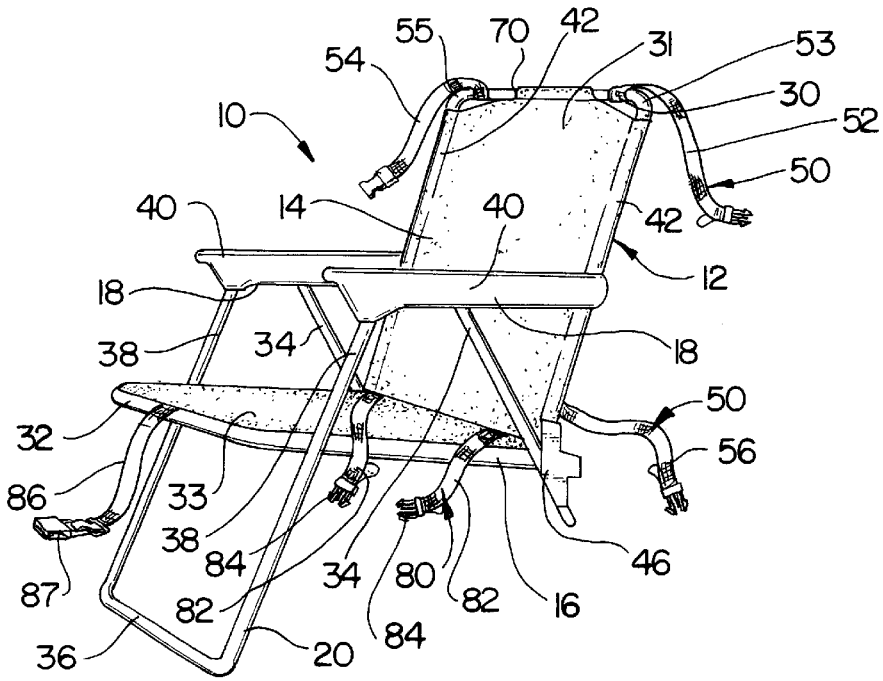
FIG. 1 is a perspective view of the child seat, shown in an open position, in accordance with a preferred embodiment thereof.

Referring to the several views of the drawings, the child seat 10 of the present invention is shown in conjunction with a conventional suitcase 100. Ideally, the suitcase 100 should be of the type including wheels 102 on the bottom end and an extendable tote handle 104 on the top end.

The child seat 10 comprises a frame structure 12 which defines the general overall configuration of the child seat, including a back rest portion 14, a seat base portion 16, arm rest portions 18, and a front leg support 20. Specifically, the frame structure includes a back rest frame 30, a seat base frame 32, arm rest support bars 34, and a generally U-shaped leg member 36. The back rest portion and seat base portion further include fabric panels 31, 33 fitted to the back rest frame 30 and seat base frame 32, respectively, to thereby provide a back rest and seat base. The arm rest support bars and upper distal ends 38 of the U-shaped leg member are pivotally fitted to respective left and right arm rests 40. The arm rests are further pivotally fitted to vertical bars 42 of the back rest frame. Finally, the lower ends of the arm rest support bars 34 are pivotally fitted to respective hinge members 46. The hinge members interconnect the back rest frame 30 and to the seat base frame 32, on opposite sides, permitting folding movement of the seat base frame relative to the back rest frame through a range of movement of approximately 100°, from a collapsed position to fully deployed, operable position. To this end, the structure of the child seat is similar to a conventional beach chair, with the exception that the child seat does not include rear legs.

Figure 2:
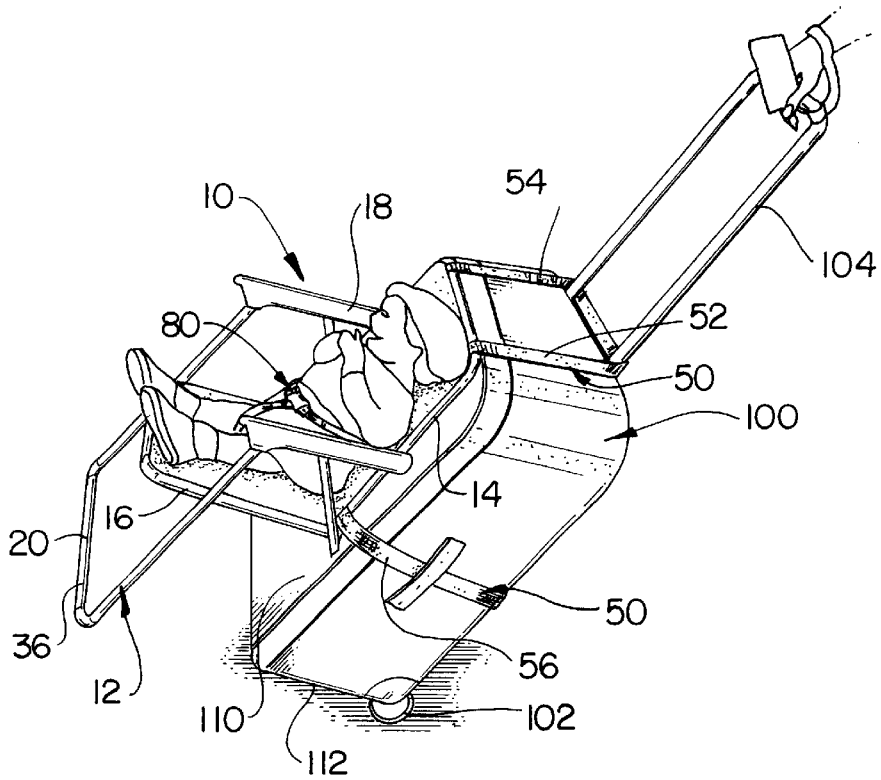
FIG. 2 is a perspective view of the collapsible child seat attached to a conventional suitcase and shown in an open and operable position with a child seated therein.
Figure 3:
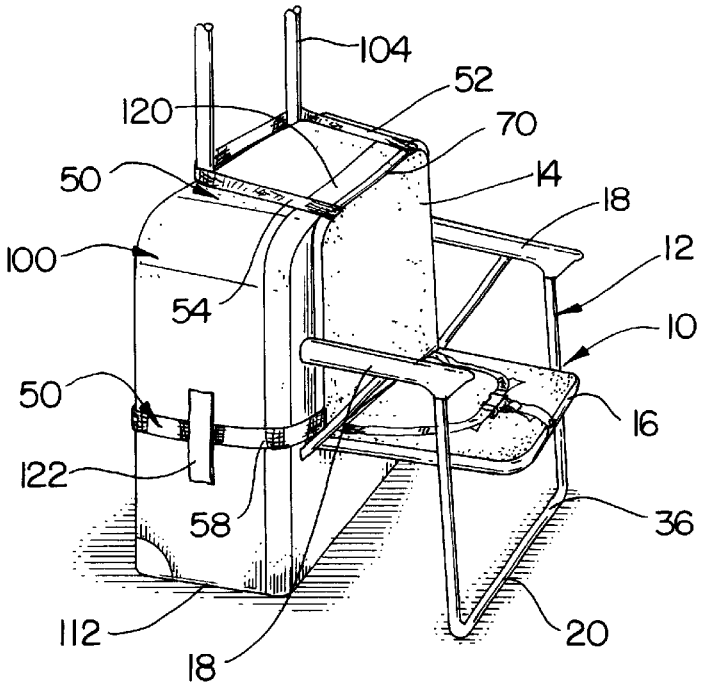
FIG. 3 is a front, side perspective view showing the child seat secured to a conventional suitcase, wherein the child seat is disposed in an operable position with the leg support of the seat engaging a ground surface to stabilize the suitcase and child seat in an upright, resting position.
Figure 4:
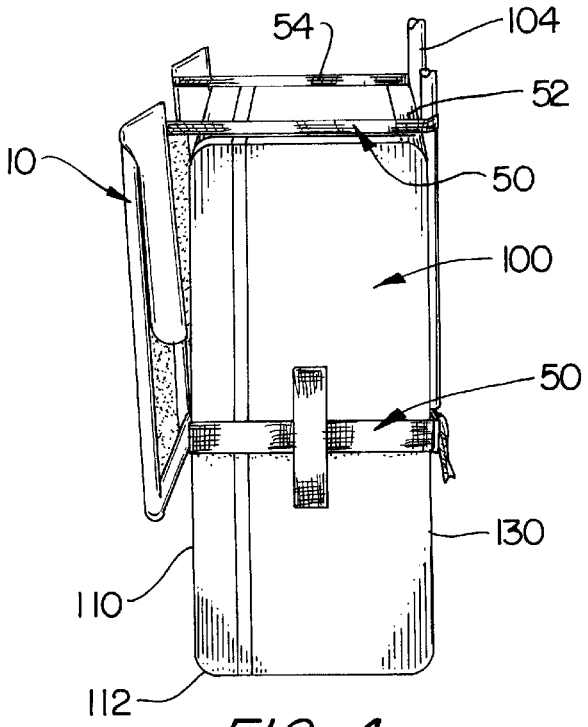
FIG. 4 is a side, top perspective view of a conventional suitcase with the child seat of the present invention fitted thereto, wherein the child seat is shown in a collapsed, stowed position against a front panel of the suitcase.
Figure 5:
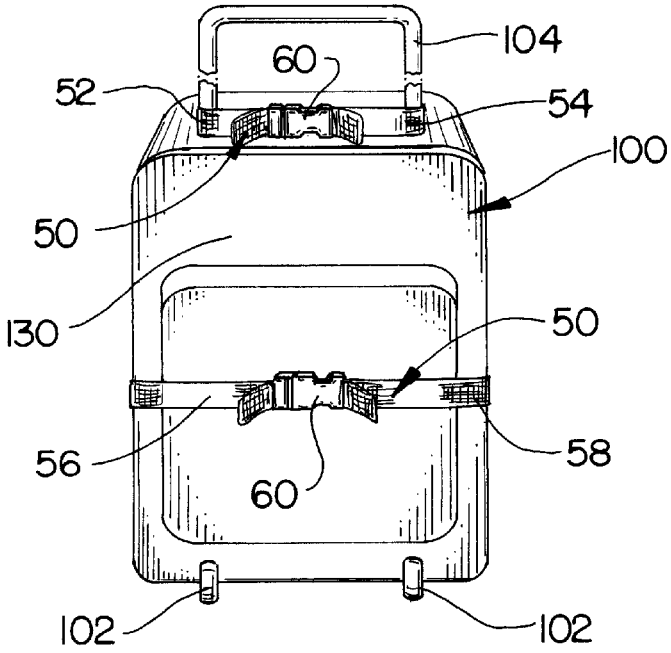
FIG. 5 is a rear, top perspective view of a conventional suitcase showing securing means for securing the child seat to the suitcase, in accordance with a preferred embodiment thereof.

Attachment means 50 are provided for removably securing the child seat 10 to the suitcase 100. In a preferred embodiment, the child seat is secured to the suitcase with the back rest portion 14 lying against the front panel 110 of the suitcase, on the upper half thereof, so that the hinge members 46 connecting the back rest frame 30 to the seat base frame 32 are spaced approximately 12 to 14 inches from the bottom end 112 of the suitcase. In this manner, when the child seat is opened to the operable position, as best seen in FIGS. 2 and 3, the lower end of the U-shaped leg support 36 is even with the bottom of the suitcase. Thus, with the seat in the operable position, the lower portion of the leg support engages the floor to help stabilize the suitcase in the upright, standing position, discouraging tipping of the suitcase which may cause injury to the child seated in the child seat.

In accordance with a preferred embodiment of the present invention, the attachment means 50 include elongate strap members secured at a proximal end to the frame structure. More specifically, the elongate strap members include an upper pair of strap members 52, 54 secured to opposite upper corners 53, 55 of the back rest frame, and a lower pair of strap members 56, 58 secured to opposite sides of the back rest frame between the hinge members and the arm rest pivot points. The distal ends of the pairs of strap members are provided with interlocking clip members 60 for releasably fastening the distal ends of the respective strap members of each pair, to thereby form a closed loop.

In accordance with the preferred embodiment, the upper pair of strap members 52, 54 are secured about the tote handle 104 so that the child seat effectively hangs on the front panel 110 of the suitcase with the upper cross bar 70 of the back rest frame adjacent the top front edge 120 of the suitcase. The lower pair of strap members 56, 58 are secured about a body of the suitcase, at an approximate mid zone thereof. It is preferable to pass one of the straps through the side carry handle 122, if available, to ensure that the lower pair of strap members do not slide up or down along the opposite sides of the suitcase. With the distal ends of the strap members of the lower pair secured on the rear panel 130 of the suitcase, the closed loop is tightened with the use of a conventional strap length adjustment fitting, thereby snugly securing the child seat to the suitcase. Once the size of the loops of each of the strap member pairs has been adjusted for a particularly suitcase, the child seat can be quickly attached and removed from the suitcase by simply releasing the clip members attaching the ends of each of the strap members.

A harness 80 is provided to safely secure the child in the child seat and includes a waist belt 82 having left and right belt segments each secured at one end to the frame structure. Opposite free distal ends of each of the strap belt segments include mating clip means 84 for fastening the two belt segments together and about the child's waist. The clip means on the belt segments is further provided with size adjustment means to facilitate tightening of the waist belt about the child. The harness further includes a crotch strap 86 extending from a front of the seat base frame and having a fastener 87 to which the clip means 84 of the belt segments attach.

Figure 6:
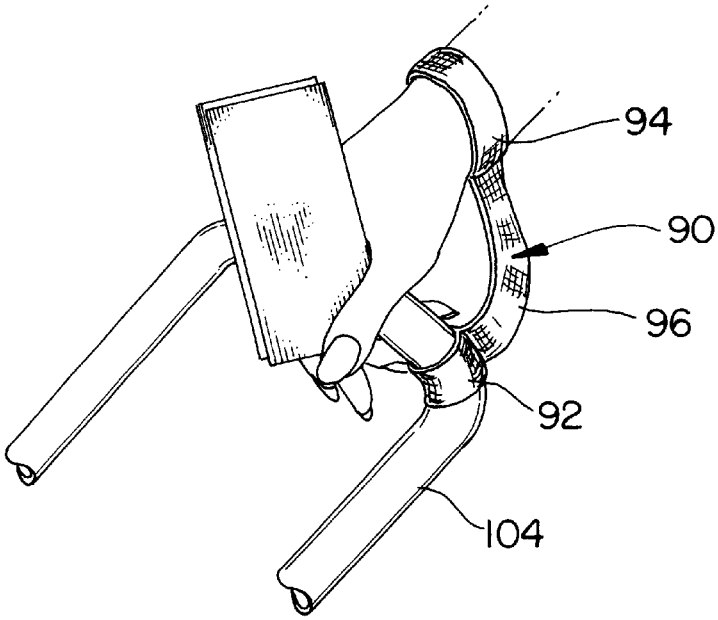
FIG. 6 is an isolated view of a safety wrist strap attachable between a tote handle of the suitcase and the user's wrist.

In order to avoid accidental dropping of the suitcase, particularly when a child is seated in the child seat on the suitcase, a safety trap 90 is provided, as seen in FIG. 6. The safety strap 90 is secured at one end 92 to the tote handle 104 to the suitcase, preferably by snap fastening members or hook and loop fastening means. An opposite end 94 of the safety strap secures about the wrist of the person carrying the suitcase. In the preferred embodiment, the safety strap includes hook and loop fastening means for releasably securing the safety strap about the user's wrist. When secured about the user's wrist, an extension 96 of approximately 8 to 12 inches remains between the tote handle and the wrist. Thus, if the person carrying or pulling the suitcase accidentally releases the tote handle, the suitcase will drop a short distance, until the extension 96 of the safety strap is taut between the wrist and the tote handle.

While the instant invention has been shown and described in accordance with a practical and preferred embodiment thereof, it is recognized that departures may be made from the instant disclosure which, therefore, should not be limited except as defined in the following claims as interpreted under the doctrine of equivalents.

What is claimed is:

1. A child seat adapted for use with a suitcase having wheels and a tote handle for transporting the suitcase along a floor surface, said child seat comprising:

a seat base;

means for moving said seat base between a collapsed position against the suitcase and an operable position permitting a child to sit thereon;

a harness for securing the child in the child seat when said seat base is in said operable position; and attachment means for removably attaching said child seat to the suitcase.

2. The child seat as recited in claim 1 further comprising a safety strap having a first end adapted to be secured to the tote handle of the suitcase and a second end adapted to be adjustably fitted and secured about a user's wrist a when transporting the suitcase along the floor surface, and said safety strap being of a length measured from the user's wrist to the tote handle to prevent the suitcase from falling to the floor surface in the event the user releases the tote handle.

3. The child seat as recited in claim 1 further comprising:

a back rest; and arm rest members.

4. The child seat as recited in claim 3 wherein said means for moving said seat base comprises hinge means for permitting folding movement of said seat base relative to said back rest.

5. The child seat as recited in claim 4 further comprising leg support means for engaging a floor surface when said seat base is in said operable position in order to stabilize the suitcase and said attached child seat in an upright, standing position.

6. The child seat as recited in claim 5 further comprising adjustment means for adjusting said attachment means to facilitate fitted attachment of said child seat to suitcases of varying sizes and configurations.

7. The child seat as recited claim 6 wherein said harness includes an adjustable size waist belt adapted to be adjustably fitted and secured about the child.

8. A child seat adapted for use with a suitcase having wheels and a tote handle for transporting the suitcase along a floor surface, said child seat comprising:

a frame structure including a back rest portion, a seat base portion, arm rest portions, and leg support means;

a back rest panel secured to said back rest portion;

a seat base panel secured to said seat base portion;

hinge means interconnecting said back rest portion to said seat base portion for permitting folding movement of said seat base portion relative to said back rest portion between a collapsed position and an open, operable position;

a harness for safely securing a child within the child seat and including an adjustable size waist belt adapted to be adjustably fitted and secured about the child;

attachment means for removably securing said child seat to the suitcase in a manner which permits said child seat to be operated between said collapsed position and said open, operable position, and wherein said leg support means engages a floor surface when said child seat is in said open, operable position, to thereby stabilize the suitcase and said attached child seat in an upright, standing position; and adjustment means for adjusting said attachment means to facilitate fitted attachment of said child seat to suitcases of varying sizes and configurations.

9. The child seat as recited in claim 8 further comprising a safety strap having a first end adapted to be secured to the tote handle of the suitcase and a second end adapted to be adjustably fitted and secured about a user's wrist a when transporting the suitcase along the floor surface, and said safety strap being of a length measured from the user's wrist to the tote handle to prevent the suitcase from falling to the floor surface in the event the user releases the tote handle.

10. The child seat as recited in claim 8 wherein said attachment means includes elongate strap members each having a proximal end secured to said frame structure and each of said strap members further including a distal end having interlocking members thereon for releasably fastening the distal ends of a respective pair of strap members to form a closed loop.

11. The child seat as recited in claim 10 wherein said strap members include an upper pair of strap members secured to said back rest portion and a lower pair of strap members secured to opposite sides of said back rest portion.

12. A suitcase comprising:

a main suitcase body;

a tote handle;

at least one wheel for rolling engagement with a floor surface upon transporting the suitcase while holding the tote handle;

a seat base attached to said main suitcase body;

means for moving said seat base between a collapsed position against said main suitcase body and an operable position permitting a child to sit on said seat base; and a harness for securing the child in a seated position on said seat base when said seat base is in said operable position.

13. The suitcase as recited in claim 12 wherein said means for moving said seat base comprises hinge means for permitting folding movement of said seat base between said collapsed position and said operable position.

14. The child seat as recited in claim 12 further comprising:

leg support means for engaging a floor surface when said seat base is in said operable position in order to stabilize the suitcase in an upright, standing position when the child is seated on said seat base.

15. A child seat adapted for use with a suitcase having wheels and a tote handle for transporting the suitcase along a floor surface, said child seat comprising:

a seat base;

a harness for securing a child in said child seat;

attachment means for removably attaching said child seat to the suitcase; and a safety strap having a first end adapted to be secured to the tote handle of the suitcase and a second end adapted to be adjustably fitted and secured about the wrist of a user when transporting the suitcase along the floor surface, and said safety strap being of a length measured from the user's wrist to the tote handle to prevent the suitcase from falling to the floor surface in the event the user releases the tote handle.

16. The child seat as recited in claim 15 further comprising:

means for moving said seat base between a collapsed position against the suitcase and an operable position permitting a child to sit on said seat base.

17. The child seat as recited in claim 16 further comprising:

arm rest members on opposite sides of said seat base.

18. The child seat as recited in claim 17 further comprising:

leg support means for engaging a floor surface when said seat base is in said operable position in order to stabilize the suitcase and said attached child seat in an upright, standing position.

19. The child seat as recited in claim 17 further comprising:

adjustment means for adjusting said attachment means to facilitate fitted attachment of said child seat to suitcases of varying sizes and configurations.

* * * * *